United States Patent [19]

Larsson et al.

[11] 4,371,396

[45] Feb. 1, 1983

[54] METHOD FOR MANUFACTURING BILLETS, FROM METAL POWDER, INTENDED TO BE SUBSEQUENTLY ROLLED OR FORGED

[75] Inventors: Hans G. Larsson; Erik Westman, both of Vasteras, Sweden

[73] Assignee: ASEA Aktiebolag, Vasteras, Sweden

[21] Appl. No.: 123,731

[22] Filed: Feb. 22, 1980

[30] Foreign Application Priority Data

Feb. 27, 1979 [SE] Sweden ..... 7901734

[51] Int. Cl.[3] ..... B22F 3/14

[52] U.S. Cl. ..... 419/56; 419/52; 419/1

[58] Field of Search ..... 75/226, 214, 200, 223

[56] References Cited

U.S. PATENT DOCUMENTS

| | | | |
|---|---|---|---|
| 3,284,195 | 11/1966 | Googin | 75/226 |
| 3,356,496 | 12/1967 | Hailey | 75/226 |
| 3,689,259 | 9/1972 | 75 | 226/ |
| 3,767,371 | 10/1973 | Wentorf | 51/307 |
| 3,982,911 | 9/1976 | Lee | 51/307 |
| 4,041,123 | 8/1977 | Lange | 75/226 |
| 4,234,661 | 11/1980 | Lee | 75/226 |

FOREIGN PATENT DOCUMENTS

| | | | |
|---|---|---|---|
| 45-31526 | 10/1970 | Japan | 75/226 |

OTHER PUBLICATIONS

*Powder Metallurgy Equipment Manual,* Metal Powder Industries Federation, 1977, pp. 21–23.

*Powder Metallurgy,* 1958, Nos. 1, 2, pp. 94–103, J. Williams.

F. F. Lange et al., The Powder Vehicle Hot—Pressing Technique, 11/4/72, pp. 563 to 565.

*Primary Examiner*—L. Dewayne Rutledge

*Assistant Examiner*—J. J. Zimmerman

*Attorney, Agent, or Firm*—Watson, Cole, Grindle & Watson

[57] ABSTRACT

A method for manufacturing billets intended to be subsequently machined into a desired shape by plastic deformation, as by rolling, includes the heating to a predetermined bonding temperature of powder grains enclosed in a capsule, and subjecting the capsule at the bonding temperature to a high pressure sufficient to bond the powder grains together to form a substantially solid body. The capsule is inserted at the bonding temperature into an over-sized forming cavity of a press which includes relatively movable punches, the capsule being completely surrounded within the press by a layer of heat-insulating and pressure-transmitting solid material, such as talc or the like. Thus, when the capsule is subjected to the high pressure upon operation of the press, such material serves as a pressure-transmitting medium through which pressure is applied completely against all sides of the capsule.

9 Claims, 3 Drawing Figures

METHOD FOR MANUFACTURING BILLETS, FROM METAL POWDER, INTENDED TO BE SUBSEQUENTLY ROLLED OR FORGED

BACKGROUND OF THE INVENTION

This invention relates to a method for manufacturing billets intended to be subsequently machined into a desired shape and dimensioned by plastic machining, such as rolling or forging. A capsule containing metal powder grains is heated to such a temperature as to insure the bonding together of the individual metal grains. The metal containing capsule is subjected to compressive forces of such a magnitude that all the voids within the capsule are pressed out to thereby effect a substantially homogeneous body having a high density. Any remaining porosity is eliminated during the subsequent forging or rolling operation, thus obtaining a material having such a theoretically high density.

The difficulty of achieving billets of a homogeneous composition and without segregations of voids at the upper portion of the ingot increases with increasing content of alloying materials when employing conventional pyrometallurgical methods. Ingot portions having segregations must be removed which results in the material gain decreasing with increasing alloying contents and an increased difficulty of achieving a homogeneous material with the desired composition. The poor output because of the high proportion of material that must be scrapped and the high price of the included alloying materials result in considerable cost and in an extreme increase in price of the finished material.

In an article entitled "The Consolidation of Metal Powders By Hot Working Within Sheaths" in *Powder Metallurgy,* 1958, Nos. 1, 2, pp. 94–103, J. Williams describes different methods of manufacturing products from powder grains. Billets or finished details may be produced directly by a number of different pressing methods. The powder is manufactured by breaking up a jet of molten metal. The metal droplets obtained are rapidly cooled and a favorable fine structure is obtained. This powder is enclosed in capsules and is machined at high pressure according to different forging or pressing methods into a solid body at a temperature which is so far below the melting temperature that undesirable structural changes through grain growth are avoided to the greatest possible extent. High-quality tool steel and superalloys have been manufactured commercially on a large scale by hot isostatic pressing of powder capsules which have been compressed in a pressure furnace and simultaneously sintered into a practically completely solid body. Both billets for rolling and forging and tools shaped to almost their desired end shape, have been manufactured. Powder-filled capsules have also been forged by tools or have been extruded. It is stated in the aforementioned article that forging in a closed tool does not result in a satisfactory product. Among other things, the capsule or sheath casing containing the metal powder becomes uneven or corrugated requiring removal of a substantial outer portion of the billet, resulting in a considerable loss of material. The problems are especially prominent in manufacturing a billet having a great height-to-diameter ratio. Thus, the method of pressing powder in capsules, as described in the aforementioned article, is inappropriate for manufacturing long billets suitable for subsequent rolling. Another drawback in connection with conventional pressing is that the powder nearest the wall of the capsule is cooled during insertion of the capsule into the press upon contact with the colder tool components which means that portions of the powder may be cooled to a temperature below the bonding temperature before it is possible to apply pressure. To a certain extent, such cooling may be counteracted by using hot tools. Heating of the tools, however, is disadvantageous since it reduces the stress values of the billet.

SUMMARY OF THE INVENTION

According to the invention, a capsule is filled with powder and is sealed. The capsule is heated at a heating station to a temperature which enables bonding but which is so far from the melting temperature that the structure through grain growth is insignificant during handling and pressing. The heated capsule is inserted into a forming cavity of a press at a pressing station and is surrounded by a layer of insulating, easily deformable material which propagates compressive forces so that the capsule will be subjected to an all-sided pressure in the absence of external heat. An almost isostatic pressure system may thereby be obtained. The thickness of the insulating and pressure-transmitting material is so chosen that the surface temperature of material nearest the wall of the capsule may be maintained at such a level that it exceeds the necessary bonding temperature when the capsule is subjected to the compacting pressure.

The capsule may advantageously be pressed between two punches relatively movable toward one another into opposite ends of an open-ended cylinder which, during pressing, is axially movable so that the friction against the wall of the cylinder interferes with compression only to the smallest possible extent.

The insulating and pressure-transmitting material may be talc, pyrophyllite or other material having similar properties. Such material must be easily deformable and capable of being redistributed relatively easily during the pressing operation, so that it will also exert radial pressure on the capsule. Talc, in the form of a talcum powder, is the most favorable material, since it is both easily available and inexpensive and has the necessary property of influencing the capsule isostatically during the pressing operation, thus effecting a radial pressure in such a manner that any folding or corrugating of the capsule sheath is substantially prevented. Also, talc has the necessary heat-insulating characteristic which is advantageous in that equalization of the temperature within the capsule may be brought about by delaying the compressing thereof until the surface layer, which has been cooled during insertion of the capsule from the heater to the press, has been re-heated by heat transfer from the inner portions of the capsule.

The insulating and force-transmitting material may be applied about the capsule in different ways. Plates and tube sleeves of this material may be produced and applied around the heated capsule while in the process of being inserted into the press. Also, the capsule may be placed on a plate or a layer of powder or grains of the insulating and pressure-transmitting material, the annular space between the capsule and the surrounding press cylinder may be filled with such material, and the capsule may then be covered with a plate or a layer of such material. To facilitate an easy filling operation, the material may be produced as a granulate or talcum powder having such a grain size distribution that the granulate is easily flowable and permits such an annular space to be substantially completely filled without voids. The properties of the talcum powder may be improved by mixing it with friction-reducing materials, for example boron nitride, graphite or molybdenum disulphide. Another possibility of reducing the friction is to spray a layer of material having lubricating properties onto the inner wall of the press cylinder. The wall temperature thereof is so low that an organic lubricant may be used, for example, polytetrafluorethylene plates and tubes or sleeves of talc may be manufactured by casting. Talcum powder may be mixed with binders and thermosetting agents. As a binder there may be used a mixture of one part 5% HCl, ten parts of ethyl silicate and fifteen parts of 90% alcohol. As a thermosetting agent there may be used one part of 5% $NH_3$ to twenty parts binder. The tubes may be cast in a centrifugal casting machine.

It is possible according to the method of the invention to press capsules having great lengths relative to their diameters. And, billets are capable of being manufactured without the capsule exterior being creased or corrugated during the pressing operation. In a single action press, a capsule having a length of five times its diameter or more may be pressed, although a length of between two and five times the diameter is suitably chosen. In a double action press with two movable punches, or in a press with a movable punch and a movable pressure cylinder, a length of between four and ten times the diameter may be suitable.

The size of the capsule produced according to the invention may vary within wide limits. However, a capsule having a small volume has a large area in relation to such volume, which may result in such a rapid cooling that it may be difficult to provide time to carry out the pressing operation before the temperature is dropped below the required temperature for obtaining satisfactory bonding. Thus, the required density for the solid body to be formed may not be obtainable.

Since it is possible according to the invention to press a capsule having a great length-to-diameter ratio, a relatively heavy capsule may be pressed using a relatively moderate pressing force. In a press having a pressing force capable of exerting 3,000 Mp at a compacting pressure of about 250 MPa, it is possible to press a capsule having a diameter of 330 mm. At a length of 1100 mm, the capsule weight is about 500 kg.

With suitable parameters, it is possible according to the invention to produce a solid body having a 100% density. When pressing powder of high speed steel, the density exceeding 99% of the theoretically possible density may be achieved at a temperature of 1150° C., a pressure of 250 MPa, and a pressing time of a few minutes. A cycle of five minutes is possible. When a billet is hot-worked after the pressing operation, for example by forging or rolling, it is not necessary to effect a complete density of the billet during pressing since the complete density may be achieved during the subsequent machining operation.

The present method provides a realistic alternative to hot isostatic pressing carried out in a pressure furnace under the action of a pressurized gas in which final compaction to a completely homogeneous material may take place during, for example, a subsequent rolling operation. The investment cost using the present method is relatively low, the cycle times are short, as short as about five minutes, and therefore the capacity is great and the costs are minimized. The present method makes powder pressing interesting for the manufacture of rolled billets of simple materials, as compared to prior pressing methods. A considerable advantage with the method according to the invention is also that the requirements placed on the material of the capsule and on the welding of joints are considerably lower as compared to isostatic hot pressing in a gaseous atmosphere. The capsule need only be filled and vibrated so that the density of the filled-in spherical powder grains becomes 65–70% of the theoretical density, the capsule then being sealed, alternatively evacuated, or evacuated and sealed with nitrogen gas prior to sealing.

Other objects, advantages and novel features of the invention will become more apparent from the following detailed description of the invention when taken in conjunction with the accompanying drawings.

DETAILED DESCRIPTION OF THE INVENTION

Figure 1:
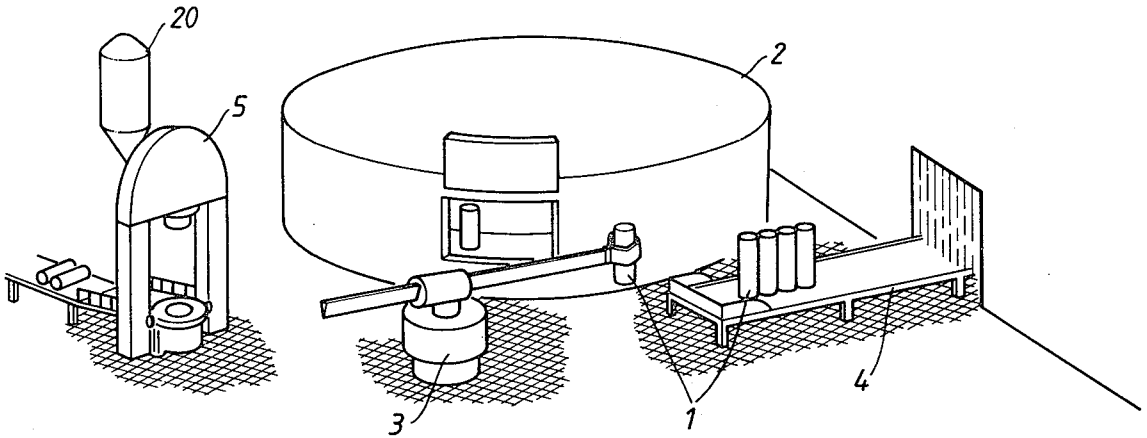
FIG. 1 is a perspective view generally showing a plant operation in which the invention is carried out.

Turning now to the drawings wherein like reference characters refer to like and corresponding parts throughout the several views, capsules 1 as shown in FIG. 1 are heated in a furnace 2 at a heating station to a temperature suitable for pressing. A manipulating robot 3, or the like, is designed for picking up each capsule 1 from a conveyor belt 4 and placing them into furnace 2 and for picking up each heated capsule from the furnace and transferring each of them to a press 5 at a pressing station.

Figure 2:
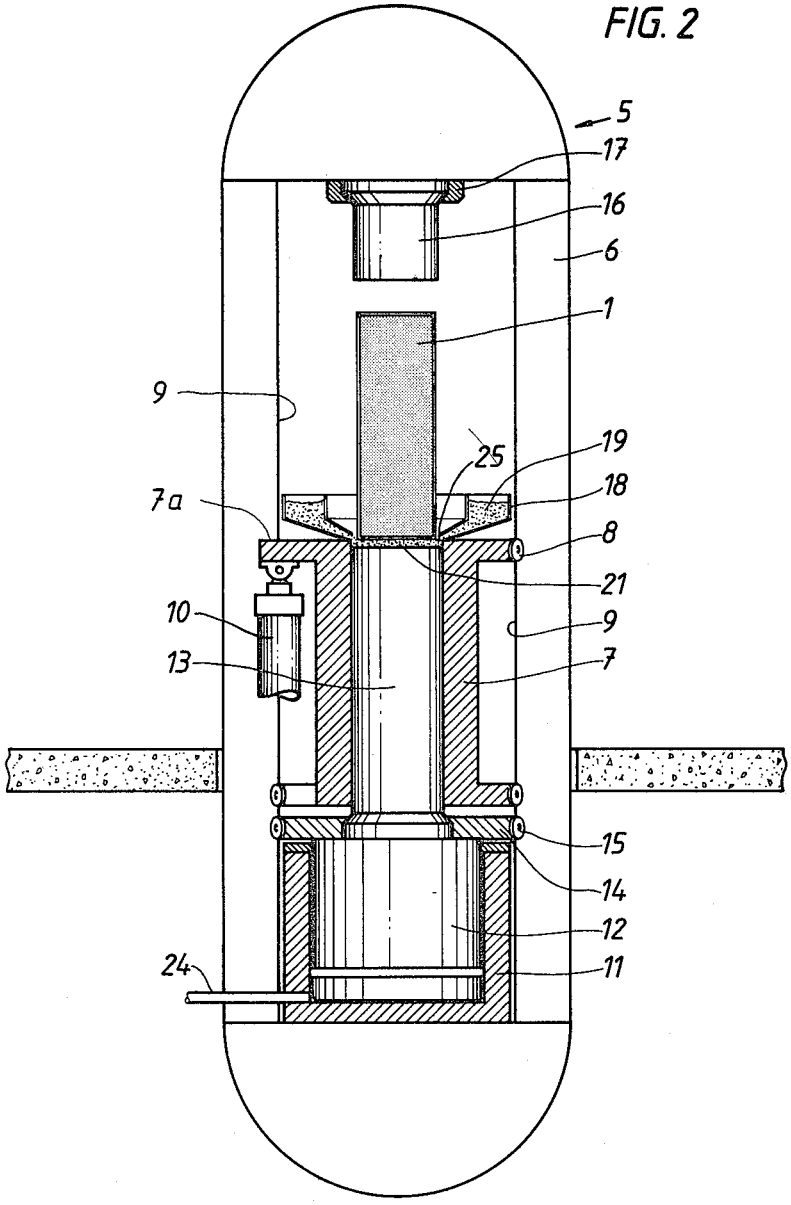
FIG. 2 is a side elevational view, partly in section, of a press during capsule loading used for carrying out the invention.
Figure 3:
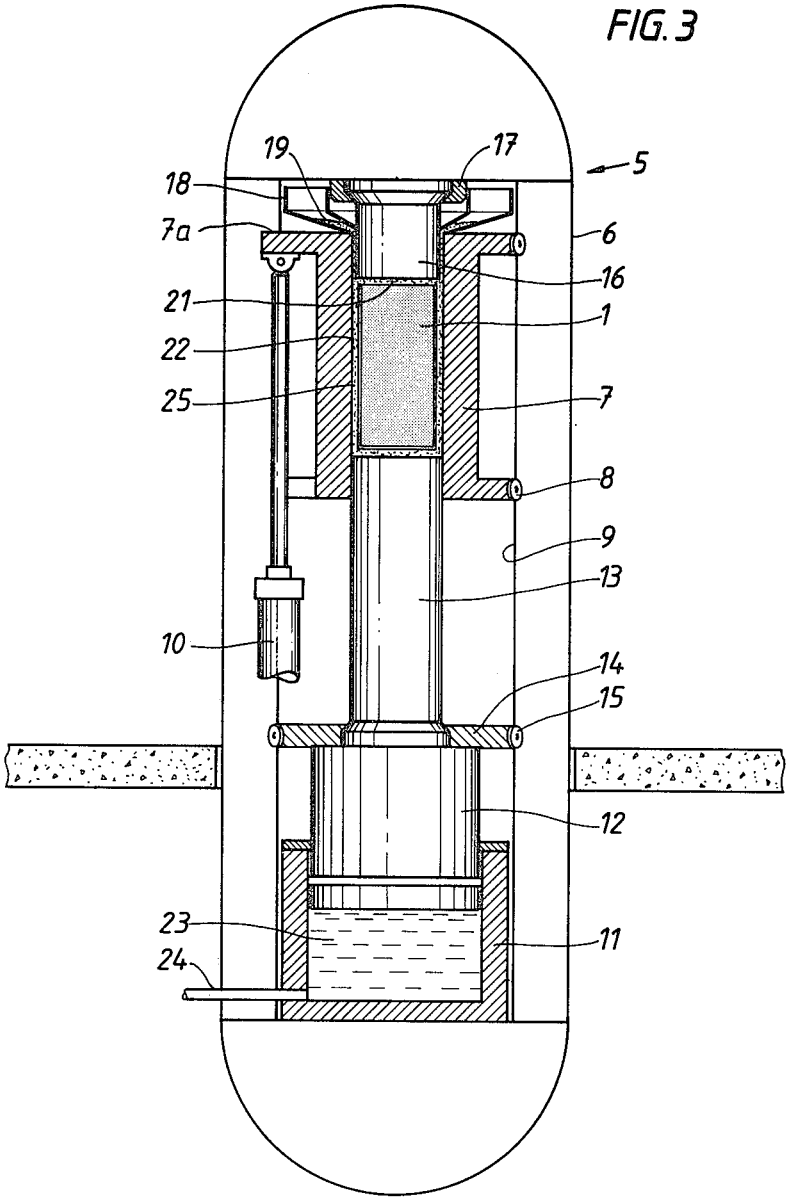
FIG. 3 is a view similar to FIG. 2 showing the termination of the capsule pressing operation.

The press, shown in detail in FIGS. 2 and 3, comprises a hydraulic press having a stand 6 and a vertically movable open-ended press cylinder 7 with guide rollers 8 thereon in rolling contact with guides 9 for guiding the cylinder along the stand between the cylinder positions of FIGS. 2 and 3. The press cylinder is capable of axial movement by means of hydraulic cylinder and piston units 10, only one being shown in FIGS. 2 and 3, between the loading position of FIG. 2 to the pressing position of FIG. 3. The pistons of these units are suitably connected to outwardly extending flanges **7*a*** on the cylinder, and the cylinders of these units are connected to a stationary portion (not shown) of the press.

At the lower portion of press stand 6 there is provided an operating hydraulic cylinder 11 containing a piston 12. A punch 13, having an outer diameter substantially equal to the inner diameter of cylinder 7 is connected to piston 12 by a holder plate 14 fixed to piston 12 in any normal manner as by bolts (not shown). Holder plate 14 is provided with guide rollers 15 in rolling engagement with guides 9 for guiding piston 12 along stand 6 between the FIG. 2 and FIG. 3 positions. Punch 13 is of such a length that its upper end lies slightly below the upper end of cylinder 7 in the loading position of FIG. 2. At the upper portion of press 5 there is provided a fixed punch 16 suspended from press stand 6 by means of a ring 17 and bolts (not shown). And, at the upper portion of press cylinder 7, there is provided an annular funnel 18 for feeding a granular heat-insulating and pressure-transmitting material 19 from a storage container 20 (FIG. 1). The material 19 may suitably comprise a talc or talcum powder which is readily available and inexpensive and at a suitable grain grating is capable of filling annular gap 22 provided between the capsule and the inner wall of cylinder 7. Gap 22 should be at least about 25 mm to facilitate a proper filling of the gap and to effect the necessary heat insulation ability of material 19. Thus, press cylinder 7 should have an inner diameter of about 50 mm larger than the outer diameter of capsule 1.

In carrying out the pressing operation as part of the method according to the invention, a plate 21 of talc is placed in cylinder 7 on punch 13. Robot 3 picks up the heated capsule 1 from furnace 2 and places it on plate 21 in the loaded position of FIG. 2. Cylinder 7 is elevated until punch 16 extends slightly into the upper end of cylinder 7. Before being elevated, gap 22 is supplied with material 19 from funnel 18 so that an insulating and pressure-transmitting layer 25 is formed about the cylindrical wall of capsule 1, and a layer 21 of material 19 is applied over the upper end of capsule 1. The outer portions of the capsule, particularly the corner portions thereof, are normally cooled during the transfer movement from the furnace to the press. It may therefore be suitable to allow the temperature within capsule 1 to become equalized by delaying the pressing operation somewhat.

Also during the process of elevating cylinder 7, space 23 between cylinder 11 and piston 12 is supplied with a pressure medium from a pressure medium source (not shown) via a conduit 24, so that the capsule is axially compressed between punches 13 and 16. During this pressing operation, which takes place in the absence of external heat, cylinder 7 may freely follow movement of the capsule, so that only a minimum of pressing force is lost by friction and sliding between the pressed capsule and the wall of cylinder 7. At the final stage of pressing, cylinder 7 is in a position shown in FIG. 3. Punch 13 and cylinder 7 are then lowered and a finished rolled billet is removed by robot 3. The capsule material must then be removed although, in many instances, such material disappears in the form of an oxide scale during the subsequent rolling and during the heating required for the rolling.

Obviously, many modifications and variations of the present invention are made possible in the light of the above teachings. It is therefore to be understood that within the scope of the appended claims, the invention may be practiced otherwise than as specifically described.

What is claimed is:

1. A method for manufacturing metallic bodies intended to be subsequently machined into a desired shape by plastic deformation, comprising the steps of filling a sheath capsule with metal powder grains, sealing the capsule closed, heating the filled and sealed capsule at a heating station to a predetermined metal powder bonding temperature, and subjecting the filled and sealed capsule at the bonding temperature to a predetermined high pressure at a pressing station in the absence of external heat until the powder grains are bonded together to form a substantially solid body, the subjecting step comprising the steps of placing one end of the capsule at the bonding temperature on a layer of deformable and heat-insulating material in an over-sized forming cavity of a press which includes at least one movable punch, said material comprising unheated talc or pyrophyllite, an annular space being defined between said press and the capsule after insertion, filling said space with said deformable material in powder or grain form with the capsule in said press, and covering a layer of said material over the opposite end of the capsule so as to completely surround the capsule, whereby said deformable material completely fills said space and influences the capsule isostatically during the subjecting step to thereby effect the application of pressure completely against all sides of the capsule such that any folding or corrugating of the capsule sheath is substantially avoided, and whereby said deformable material has the necessary heat-insulating characteristic such that equalization of the temperature within the capsule is brought about by delaying the compressing thereof until the surface layer, which may have cooled between said heating and subjecting steps, has been re-heated by heat transfer from the inner portion of the capsule.

2. The method according to claim 1, wherein the forming cavity includes an axially movable, open-ended cylinder, said press including a pair of punches relatively movable into opposite ends of said cylinder, the subjecting step further comprising the step of axially moving said cylinder during relative movement of said punches for applying axial pressure at opposite ends of the capsule.

3. A method for manufacturing metallic bodies intended to be subsequently machined into a desired shape by plastic deformation, comprising the steps of filling a sheath capsule with metal powder grains, sealing the capsule closed, heating the filled and sealed capsule at a heating station to a predetermined metal powder bonding temperature, and subjecting the filled and sealed capsule at the bonding temperature to a predetermined high pressure at a pressing station in the absence of external heat until the powder grains are bonded together to form a substantially solid body, the subjecting step comprising the steps of placing one end of the capsule at the bonding temperature on a layer of deformable and heat-insulating material, said material comprising unheated talc or pyrophyllite, inserting the capsule with said layer into an over-sized forming cavity of a press which includes a pair of punches with at least one thereof being movable relative to the other, an annular space being defined between said press and the capsule after insertion, filling said space with said deformable material in powder or grain form with the capsule in said press, and covering a layer of said material over the opposite end of the capsule, so as to completely surround the capsule, whereby said deformable material completely fills said space and influences the capsule isostatically during the subjecting step to thereby effect the application of pressure completely against all sides of the capsule such that any folding or corrugating of the capsule sheath is substantially avoided, and whereby said deformable material has the necessary heat-insulating characteristic such that equalization of the temperature within the capsule is brought about by delaying the compressing thereof until the surface layer, which may have cooled between said heating and subjecting steps, has been re-heated by heat transfer from the inner portion of the capsule.

4. The method according to claim 3, wherein the forming cavity includes an axially movable, open-ended cylinder, said punches being relatively movable toward one another into opposite ends of said cylinder, the subjecting step further comprising the step of axially moving said cylinder during relative movement of said punches for applying axial pressure at opposite ends of the capsule.

5. The method according to claim 1 or 3, wherein said surrounding step includes the step of applying layers of the deformable material to the opposite ends of the capsule and a sleeve of the deformable material to the remaining side of the capsule within said cavity.

6. The method according to claim 1 or 3, wherein said deformable material comprises a talcum powder which is readily flowable and has a predetermined grain size distribution permitting said space to be substantially completely filled.

7. The method according to claim 1 or 3, wherein the capsule is subjected to said high pressure until all voids within the capsule are pressed out to thereby produce the solid body as having a 100% density, the body being subjected to subsequent treatment to achieve desired strength values.

8. The method according to claim 1 or 3, wherein said deformable filling material is mixed with friction reducing material selected from the group consisting of boron nitride, graphite and molybdenum disulphide.

9. The method according to claim 1 or 3, wherein the wall of the cylinder is provided with a friction reducing material comprising polytetrafluorethylene.

* * * * *